United States Patent [19]

Minks

[11] 3,958,198

[45] May 18, 1976

[54] MAGNETO SYSTEM INCLUDING A TILTABLE U-SHAPED ARMATURE

[75] Inventor: Werner Minks, Kleingeschaidt, Germany

[73] Assignee: International Standard Electric Corporation, New York, N.Y.

[22] Filed: Nov. 15, 1974

[21] Appl. No.: 524,099

[30] Foreign Application Priority Data

Nov. 19, 1973 Germany ..... 2357575

[52] U.S. Cl. ..... 335/128; 335/203

[51] Int. Cl.[2] ..... H01H 67/02

[58] Field of Search ..... 335/128, 203, 270, 276, 335/279, 274

[56] References Cited

UNITED STATES PATENTS

| | | | |
|---|---|---|---|
| 2,693,554 | 11/1954 | Vigren et al. | 335/276 |
| 2,786,915 | 3/1957 | Zupa | 335/276 |
| 3,340,487 | 9/1967 | Gruner et al. | 335/279 X |
| 3,444,491 | 5/1969 | Whitaker | 335/128 |

*Primary Examiner*—George Harris
*Attorney, Agent, or Firm*—John T. O'Halloran; Menotti J. Lombardi, Jr.; Richard A. Menelly

[57] ABSTRACT

An improved magneto system of the type employing a U-shaped tiltable armature within an electromagnetic relay wherein the armature is capable of tilting to provide an operable airgap between the armature and the yoke in order to increase the magnet force against the contacts when one of the contacts becomes stuck. The improvement provided a three-point support to the armature by resting each of the armature arms on its corresponding contact spring bank and resting a portion of the center region of the armature on the yoke.

4 Claims, 4 Drawing Figures

MAGNETO SYSTEM INCLUDING A TILTABLE U-SHAPED ARMATURE

BACKGROUND OF THE INVENTION

The present invention relates to a magneto system for the use in relays employing a yoke entending along the field coil, and a tilting armature embracing the coil in a U-shaped manner, with the tilting armature tiltably supported in the plane of its support walls and in the plane of its front plate, according to U.S. Pat. No. 3,836,878, issued Sept. 17, 1974. There is a particular need for the invention in miniature relays having a maximum overall height of 11 mm.

The aforementioned U.S. Patent Application describes a magneto system for the use in relays in which the armature is not only capable of being tilted in the plane of its arms' walls, but also in the plane of its armature front plate. This design provides in addition to the normal pole area on the front plate of the U-shaped tilting armature, two additional pole areas on the U-shaped arms opposite the yoke plates arranged along the field coil, in order to capture the stray flux and to produce an additional magnetic force. This method provides a particularly good magnetic flux and produces an increased pulling force when one of the contact spring banks on the two longitudinal sides of the coil is unable to be actuated without further action by the armature due to stuck contacts. The tilting movement of the armature in the plane of its front plate reduces the size of the operating airgap and a portion of the airgap between the armature arms and the yoke plate thereby increasing the magnetic flux in the armature. When one contact of the contact spring bank arranged on the two longitudinal sides of the coil becomes stuck, the armature, upon actuation, tilts with its front plate towards the core surface and, together with its still movable armature arm, tilts in the direction towards the yoke, thus causing the magnetic flux in the armature to increase. This exerts a greater tilting moment upon the untilted armature arm, and facilitates pulling-off the stuck contact.

A disadvantage with the aforementioned device is the failure to provide a defined bearing of the armature in all cases so that the tolerances within the contact system still require adjustment.

SUMMARY OF THE INVENTION

It is an object of this invention to compensate for height tolerances of the contact spring banks as arranged at the two longitudinal sides of the coil thereby permitting the customary adjustment of the contact system to be omitted. In a magneto system of the kind mentioned above, this problem is solved by the invention, in that in every position of the armature, the latter will rest with its arms either directly or indirectly on the contact spring banks as arranged at the two longitudinal sides of the coil, and that one gap each is arranged between the armature arms (legs) and the yoke.

The invention provides a defined three-point bearing for the armature in every position thereof. Greater tolerances are admissible between the actuating system and the contact system, since these differences are now compensated for by the magnetic circuit, i.e. by the three-point bearing of the armature. The magneto system also produces an increased pulling force in the event of a sticking of one of the two contact spring banks.

A further embodiment of the invention provides that the armature, with a center region of its front plate facing the yoke plate, is almost punctually supported in a stationary part of the relay. The armature is thereby capable of tilting with minimum friction in the plane of its front wall (plate), as well as in the planes of its arms' walls, about two axes which extend vertically in relation to one another.

The punctual bearing for the armature front plate has a slight clearance in a vertical direction relative to the yoke plate. The armature is thereby compelled to perform a restricted tilting movement. The armature, in the event of a sticking of one contact of the spring bank, is suddenly retarded in its tilting movement when the operating airgap on the core surface of the coil becomes reduced. The now increasing magnetic force and, consequently, the armature force are now available for releasing the sticking contact spring bank. This embodiment offers the additional advantage of providing a more stable support for the armature in the normal operating position.

Further details of the invention will now be explained with reference to an example of embodiment shown in FIGS. 1 to 4 of the accompanying drawings, in which:

DESCRIPTION OF THE PREFERRED EMBODIMENT

Figure 3:
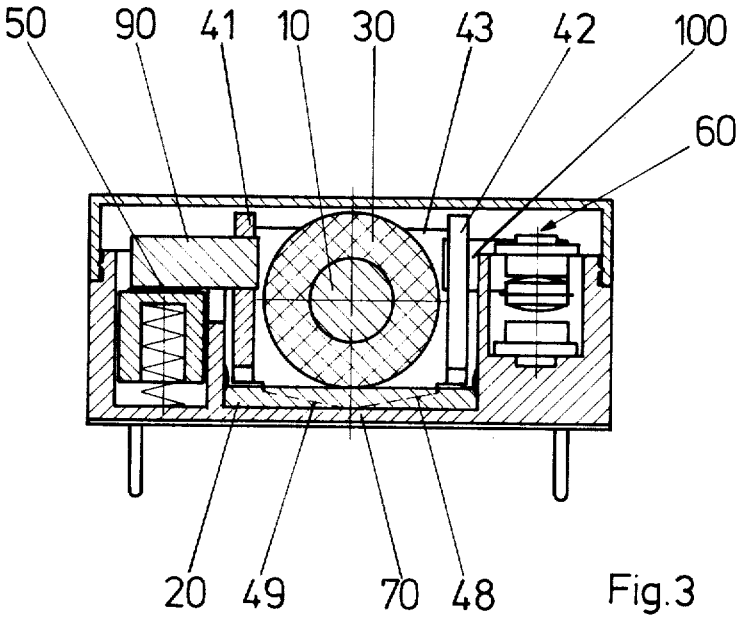
FIG. 3 is a cross-sectional view taken along the line E–F of the relay of FIG. 1.
Figure 4:
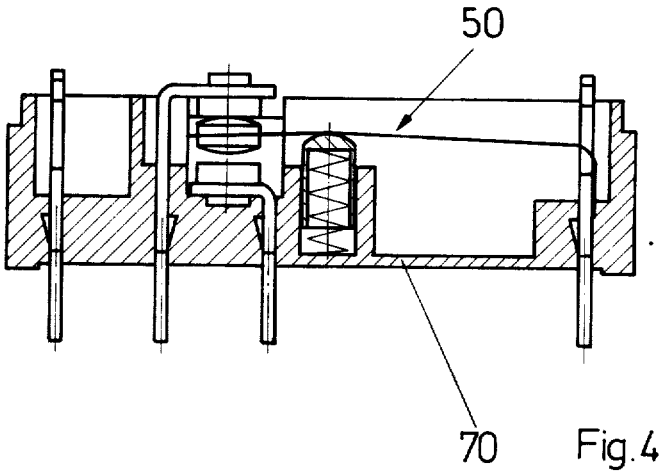
FIG. 4 is a cross-sectional view of the relay of FIG. 1 taken along the line C–D.

The magneto or excitation system of the relay shown in FIG. 3, consists of the core 10, the L-shaped yoke 20 to the smaller leg (arm) of which the excitation coil 30 is firmly anchored to the core, and of the U-shaped designed armature 40 the two arms (legs) 41, 42 which are arranged in parallel with the longitudinal axis of the coil. The magnetic circuit as consisting of the core 10 and of the yoke 20, is completed by the U-shaped armature 40. The armature front plate 43 as arranged opposite the core surface 11 is extended in direction towards the yoke 20 and opposite the left- and right-hand armature legs (arms) 41, 42, so that the armature front plate will come to lie in front of the yoke.

Figure 2:
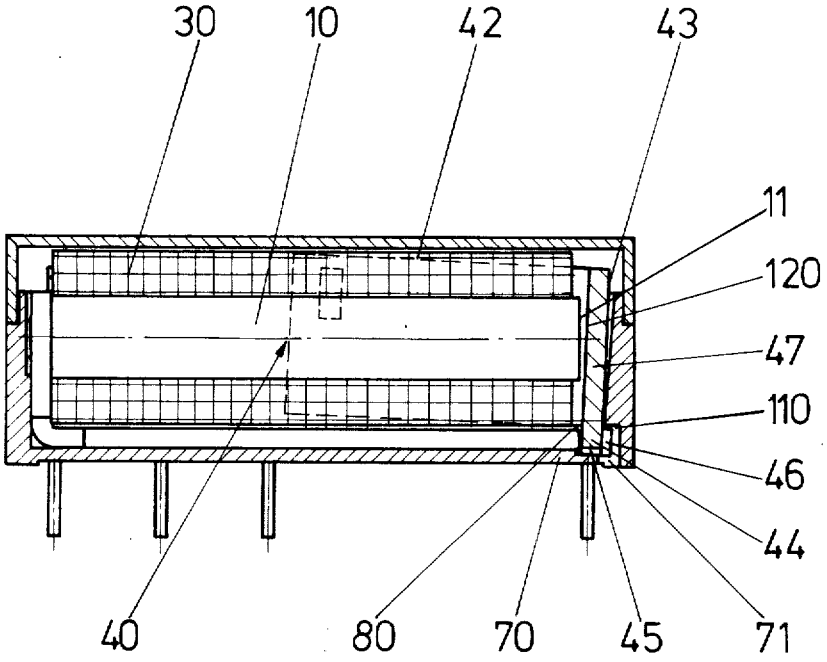
FIG. 2 is a longitudinal section taken along the line A–B of this relay.

Referring to FIG. 2, the contact can be seen as established between this projecting portion 44 of the armature front plate 43 and the yoke 20 enables an improved magnetic flux between the yoke and the armature 40.

Figure 1:
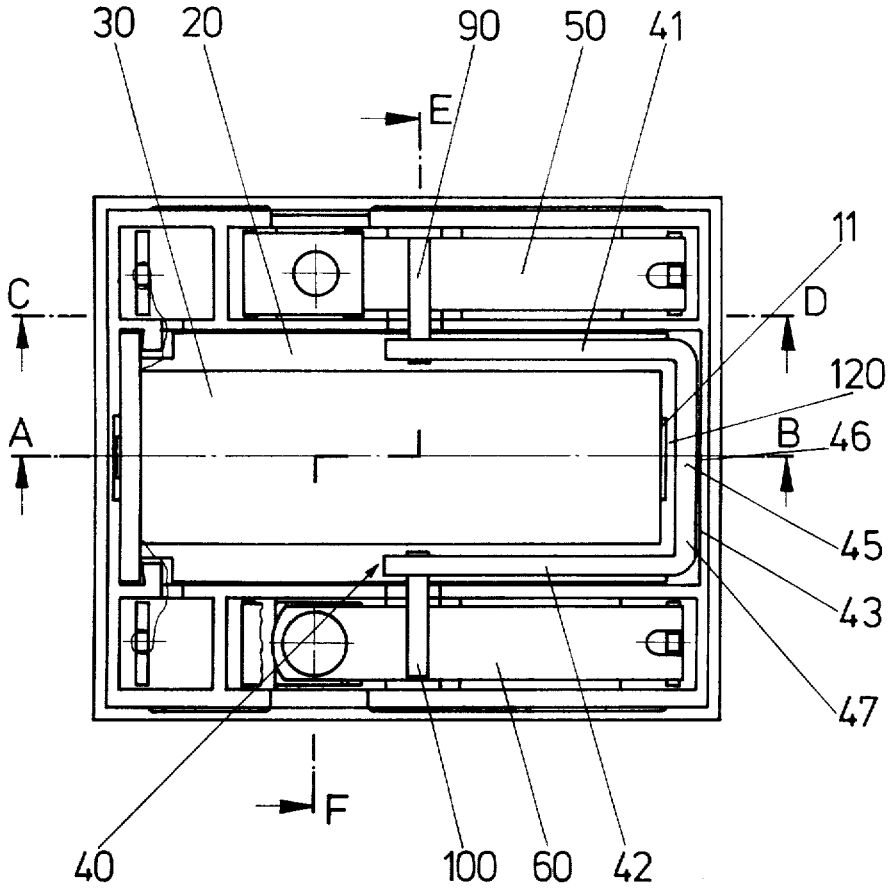
FIG. 1 is a top view of a miniature relay according to the invention.

For the purpose of forming a defined three-point bearing, as shown in FIGS. 2 and 3, the armature 40 rests with its arms (legs) 41, 42 indirectly on the contact spring banks 50, 60 as arranged at the two longitudinal sides of the coil 30 and, with a central region 45 of its front plate 43 as facing the yoke plate 20, is almost punctually supported in a stationary part of the relay, i.e. the housing 70, whereas in every position of the armature a gap 80 is maintained between the armature arms (legs) and the yoke plate. Accordingly, the armature 40 will rest with the surfaces of its armature legs 41, 42 neighboring the yoke 20 neither in its operating position nor in its normal position. The width of the gap 80 between the yoke plate 20 and the adjacent surfaces of the armature legs 41, 42, in the operating position of the armature 40, ranges between 0.2 and 0.3 mm approximately. Actuating pins (bolts) 90, 100, are used as the indirect bearing for armature legs 41, 42 on the contact spring banks 50, 60 and assist to actuate the contacts. This structure is shown more clearly on FIG. 1. These actuating pins rest directly on the contact springs of the spring banks 50, 60 in every position of the armature 40. Owing to the punctual bearing of the armature front side 43 on a part of the housing 70, and the bearing of the actuating pins 90, 100 on the contact springs of the spring bank 50, 60, a defined three-point bearing is provided in every position of the armature 40. Height tolerances of the contact spring banks 50, 60 as arranged at the two longitudinal sides of the coil 30, are thus compensated for in every position of the armature 40.

In order to restrict the extent of tilting movement of the armature 40, the punctual bearing for the front side 43 of the armature is given a slight clearance (play) in a vertical direction relative to the yoke plate 20. This clearance is enabled by the gap 110 as provided for between the housing 70 and the center region 45 of the front wall 43 of the armature. In this way the armature 40 is retarded in its tilting movement in relation towards the core surface 11 in the event of a sticking contact, and the operating airgap 120 is reduced. The thus increasing armature force will then be available for releasing the sticking contact bank (assembly).

A particularly space-saving arrangement is obtained from a center region 45 of the armature front plate 43 as facing the yoke plate 20, since there is a joining piece 46 by which the armature front plate is supported in a recess 71 provided for in the housing 70 of the relay, such that in the normal position of the armature 40, the surface of the joining piece 46 as facing the bottom of the housing 70, will rest thereon and that between the surface of the joining piece not facing the resting surface, and the limiting wall of the recess 71 as lying opposite this surface, there is formed a gap 110 serving to limit the tilting movement of the armature, while the remaining surfaces of the joining piece 46 are lying freely, so that the joining piece merely prevents the center of the armature 40 from moving away from the plane occupied in the normal operating position. Consequently, this type of embodiment also safeguards the automatic restoration of symmetry as regards the operating position.

Modifying the type of embodiment shown in FIG. 2, in such a way that instead of the joining piece 46 as formed thereon, there is used a joining piece arranged in the center region 45 of the longitudinal side of the armature front plate 43, but below the yoke end 20, would cause the same functions but would require a larger overall height. For this reason details of such an embodiment will not be explained in greater detail herein. A further modification would also be possible by arranging the gap 80 between the armature legs 41, 42 and the yoke plate 20 so as not to extend over the entire length of the armature legs. In fact, the armature legs 41, 42 could fully rest on the yoke 20 with a portion not facing the armature front plate 43 in the normal operating position, whereas the gap 80 would have to be arranged between the armature legs and the yoke within a region facing the armature front plate 43. This type of embodiment, however, would have the disadvantage of providing for a statically indefinite bearing of the armature 40. The joining piece 46 could also be replaced by a tongue projecting out at the yoke end 20, permitted to project through a corresponding opening in the face side 43. It is essential with respect to such a modification, that the center region 45 of the armature 40 is prevented from moving away from its support.

It is also possible, however, to provide inclined surfaces 48, 49 on the front plate 47 of the armature 40 on either side of the joining piece 46 as shown on FIG. 3 for safeguarding an exact measure for the tilting movement of the armature in the plane of the armature front plate 43 in cases where one of the contact spring banks 50, 60 should happen to stick. These inclined surfaces might be replaced by corresponding recesses provided for in the neighboring stationary part.

What is claimed is:

1. An improved magneto system for use in relays employing a housing, a yoke member, a field coil, and a tilting U-shaped armature partially surrounding the coil so that the armature is capable of tilting both in the plane of the arms of the armature as well as in the plane of the front plate of the armature, wherein the improvement comprises:

a pair of contact springs one on either side of the field coil; and a tiltable U-shaped armature having a pair of arms arranged parallel to said coil each of said arms attached to and supported by one of said springs, whereby each of said arms is separated from the yoke by a variable airgap.

2. The magneto system of claim 1 wherein said armature further comprises a center region oppositely adjacent said yoke, intermediate and perpendicular to said armature arms; said center region pivotably contacting said housing at a point for providing punctual support thereon to said armature.

3. The magneto system of claim 2 wherein said center region further provides a variable air separation gap therebetween said armature and said yoke.

4. The magneto system of claim 3 wherein the center region of said armature oppositely adjacent said yoke further includes an extension thereon and wherein said housing further includes a recess subjacent to said extension so that a bottom part of said extension contacts said recess when the armature is in a normal operating position, and wherein said housing further includes a gap within said recess oppositely adjacent said extension for providing a stop to said armature for limiting the tilting motion therebetween said armature and said yoke.

* * * * *